United States Patent [19]

Müller

[11] Patent Number: 4,891,870

[45] Date of Patent: Jan. 9, 1990

[54] NEEDLING APPARATUS FOR MAKING A PATTERNED FELT WEB

[75] Inventor: Karl Müller, Wels, Austria

[73] Assignee: Textilmaschinenfabrik Dr. Ernst Fehrer Aktiengesellschaft, Leonding, Austria

[21] Appl. No.: 249,783

[22] Filed: Sep. 27, 1988

[30] Foreign Application Priority Data

Oct. 1, 1987 [AT] Austria ..... 2500/87

[51] Int. Cl.[4] ..... B32B 5/06; D04H 1/46; D04H 5/02

[52] U.S. Cl. ..... 028/107; 028/113

[58] Field of Search ..... 364/470; 28/107, 109, 28/113

[56] References Cited

U.S. PATENT DOCUMENTS

| | | | |
|---|---|---|---|
| 2,896,302 | 7/1959 | Costello | 28/113 |
| 2,902,746 | 9/1959 | Bateman | 28/107 |
| 3,010,178 | 11/1961 | Rust, Jr. | 28/107 |
| 3,391,436 | 7/1968 | Fehrer | 28/107 |
| 3,656,177 | 4/1972 | Chung et al. | 28/107 X |
| 3,681,822 | 8/1972 | Sanders | 28/107 |

OTHER PUBLICATIONS

Putting Patterns, Into Needlefelts, Knaus et al, Textile Manufacturer, 07/1972, vol. 99, No. 1169, pp. 48–51.

*Primary Examiner*—Werner H. Schroeder
*Assistant Examiner*—Jodi A. Tokar
*Attorney, Agent, or Firm*—Kurt Kelman

[57] ABSTRACT

A needling apparatus for making a patterned felt web comprises at least one needle board, which is connected to a needle board drive, a feed drive for feeding the felt web through a felt guide between a felt support and a stripper, and means for adjusting the stroke position of the needle board relative to the felt guide between an idle stroke position and a working stroke position for the largest depth of penetration. To permit an increase of the average feeding speed along a series of patterns, the feeding speed imparted to the feed web by the feed drive is adapted to be controlled in dependence on the stroke position of the needle board relative to the felt guide in accordance with a predetermined coordination between the stroke position of the needle board and the feeding speed of the felt web.

1 Claim, 3 Drawing Sheets

NEEDLING APPARATUS FOR MAKING A PATTERNED FELT WEB

BACKGROUND OF THE INVENTION

1. Field of the Invention

This invention relates to a needling apparatus for making a patterned felt web, which apparatus comprises at least one needle board, connected to a needle board drive, a feed drive for feeding the felt web through a felt guide between a felt support and a stripper, and means for adjusting the stroke position of the needle board relative to the felt guide between an idle stroke position and a working stroke position for the largest depth of needle penetration.

2. Description of the Prior Art

In needling apparatuses of that iknd, forked needles are used to form fiber loops, which protrude above the surface of the smooth web of needled felt. Such surface texture may provide a pattern on the felt web. The design of such pattern will obviously depend on the length of the feed movement which is imparted to the felt web as it is needled and on the depth of penetration and on the density of penetration of the needles. The depth of penetration of the needles will be determined by the setting of the relative stroke position of the needle board relative to the felt guide. Either the felt guide is adjusted relative to a predetermined stroke position of the needle board or the stroke position of the needle board is adjusted relative to the stationary felt guide. Because the setting of the stroke position of the needle board relative to the felt guide can be effected in a range between a working stroke position for the largest depth of penetration and an idle stroke position in which there is no penetration, widely varying surface patterns of the felt web including length sections having different loop lengths and length sections having no loops may result. The known needling apparatuses of that kind have the disadvantage that the feeding speed of the felt web must be determined in dependence on that patterned length section in which the largest loops and the densest loops are formed so that said feeding speed cannot be increased beyond a predetermined limit and, as a result, there is a limit to the throughput capacity of the needling apparatus.

SUMMARY OF THE INVENTION

For this reason, it is an object of the invention to avoid that disadvantage and so to improve with simple means a needling apparatus which is of the kind described first hereinbefore and serves to make a patterned felt web that the throughput capacity will be greatly increased.

That object is accomplished in accordance with the invention by controlling the feeding speed imparted to the feed web by the feed drive in dependence on the stroke position of the needle board relative to the felt guide in accordance with a predetermined coordination between the stroke position of the needle board and the feeding speed of the felt web.

Because the feeding speed of the feed drive is additionally controlled, the average feeding speed for a given series of patterns can be greatly increased over the feeding speed which is permissible in known needling apparatuses and that increase can be achieved without a use of speeds which exceed the limits associated for a certain range of depths of penetration. For instance, when the needle board is in its idle stroke position it will be possible to feed the felt web at a maximum feeding speed, whic corresponds to a multiple of the feeding speed which is permissible during the needling operation. Besides, if the felt web is fed at different feeding speeds along spaced apart patterned length sections whereas the needle board is maintained in a given stroke position, i.e., the depth of penetration is not changed, it will be possible to vary the depth of penetration within wide limits while the needle board is operated at a given stoke frequency. This will increase the variety of patterns which can be provided on the felt web. For that purpose, the coordination of the stroke position of the needle board and the feeding speed of the felt web, which coordination will determine the control, must be selected in accordance with the series of patterned portions.

It need not be emphasized that a control of the feeding speed of the feed drive in dependence on the stroke position of the needle board will require that the stroke position of the needle board is detected and the feeding speed of the felt web is then controlled in accordance with the predetermined coordination in dependence on the stroke position. It will be understood that the results of the invention will also be obtained if the feeding speed of the feed drive, on the other hand, are separately controlled in accordance with the predetermined coordination of the stroke position of the needle board and the feeding speed of the felt web and this is performed in accordance with a predetermined flow chart because it is sufficient to ensure that a change of the depth of penetration will be accompanied by a change of the feeding speed of the felt drive if this is required in accordance with the predetermined coordination of said two parameters.

DETAILED DESCRIPTION OF THE PREFERRED EMBODIMENT

Figure 1:
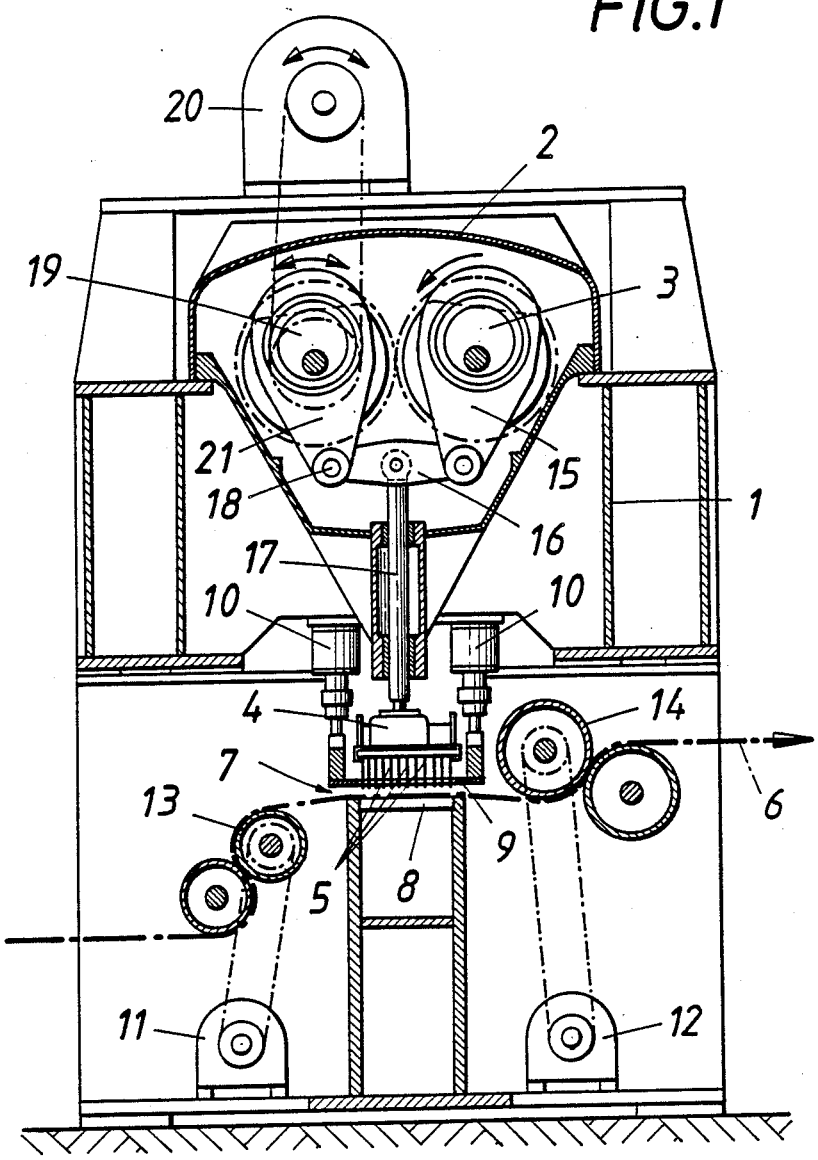
FIG. 1 is a simplified longitudinal sectional view showing a needling apparatus in accordance with the invention which serves to make a patterned felt web.

The invention is illustrated by way of example in the drawing.

Figure 2:
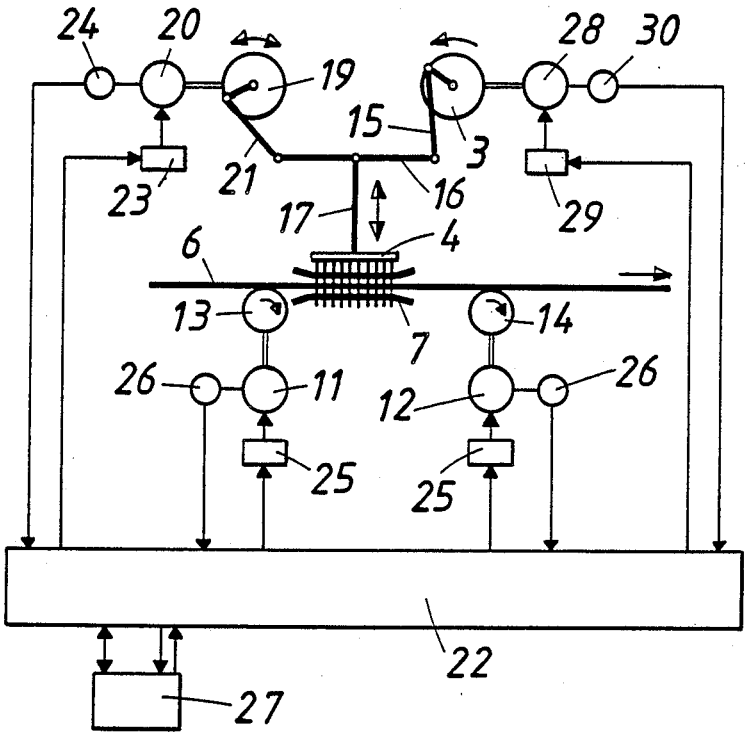
FIG. 2 is a block circuit diagram showing the control system of that needling apparatus.

In the illustrative embodiment shown in FIGS. 1 and 2, the needling apparatus comprises a housing 2, mounted in a frame 1 and containing a needle board drive 3, which actuates a needle board 4 having a multiplicity of needles 5, penetrating into the felt web 6 from above. Adjacent to the needle board 4, a felt guide 7 for the felt web 6 is provided, which is constituted by a felt support 8 and a stripper 9. The felt support 8 consists of a strip grate. For an adaptation to felts differing in thickness, the stripper 9 can be displaced in height by means of setting cylinders 10. The stripper 9 is provided with a multiplicty of spaced apart passage openings for respective needles 5 of the needle board 4. The feed drive for the felt web is constituted by two electric motors 11 and 12, which drive an intake roller 13 and a delivery roller 14, respectively.

The drive 3 for actuating the needle board 4 consists of a drive eccentric, connected by connecting rods 15 to rockers 16. The needle board 4 is carried by push rods 17, which are pivoted to the rockers 16 and displaceably mounted in the housing 2. For the setting of the stroke position of the needle board 4, the swivel bearings 18 of the rockers 16 are movably mounted on a setting mechanism 19, which comprises a setting eccentric, adapted to be driven by a setting motor 20 and provided with connecting rods 21, which carry the swivel bearings 18 for the rockers 16. In that arrangement, the stroke position of the needle board 4 relative to the felt guide 7 can be adjusted infinitely between an idle stroke position, in which the needles 5 do not penetrate the felt web 6, and a working stroke position for the largest depth of penetration. That adjustment can be effected even during the needling operation.

In order to permit the average feeding speed of the felt web 6 along a given series of patterns to be increased, on the one hand, and to permit an additional variation of the patterns, on the other hand, the feeding speed of the felt web 6 can be controlled in dependence on the stroke position of the needle board 4. For that purpose, a controller 22 is provided, which comprises a drive control computer and which controls the setting motor 20 by means of a drive controller 23. The actual value of the stroke position of the needle board 4 is detected by a signal generator 24, associated with the setting motor 20. The output signal of the generator 24 is fed back to the controller 22, in which the desired and actual values are compared. The feeding speed of the felt web 6 is controlled at the same time as the stroke position of the needle board. The control of the feeding speed is performed in accordance with a pregiven coordination of the feeding speed of the felt web and the actual value of the stroke position of the needle board 4. That coordination will depend on the series of the differently patterned length portions of the felt web. The feeding speed is automatically controlled by two drive controllers 25 associated with the electric motors 11 and 12, respectively, which are operatively connected to the intake roller 13 and the delivery roller 14, respectively. The actual feeding speed of the rollers 13 and 14 is detected by sensors 26, which deliver output signal to the controller 22 for a comparison of the desired and actual values.

To make a desired pattern, the controller 22 is initially fed via an entry device 27 with the data which will determine that coordination of the feeding speed of the felt web 6 and the stroke position of the needle board 4 which is required for the desired series of patterns. When that coordination has been determined in accordance with a program, the drive computer controls the stroke position of the needle board 4 and the feeding speed of the felt web 6 in the predetermined coordination.

The stroke frequency of the needle board 4 is also controlled via the drive computer of the control system 22, which is connected by a drive controller 29 to the main drive motor 28 for the lifting drive 3. The actual value of the stroke frequency can be detected by a suitable signal generator 30, which is operated at the speed of the main drive motor 28 and delivers cooresponding signals to the control system 22.

Figure 3:
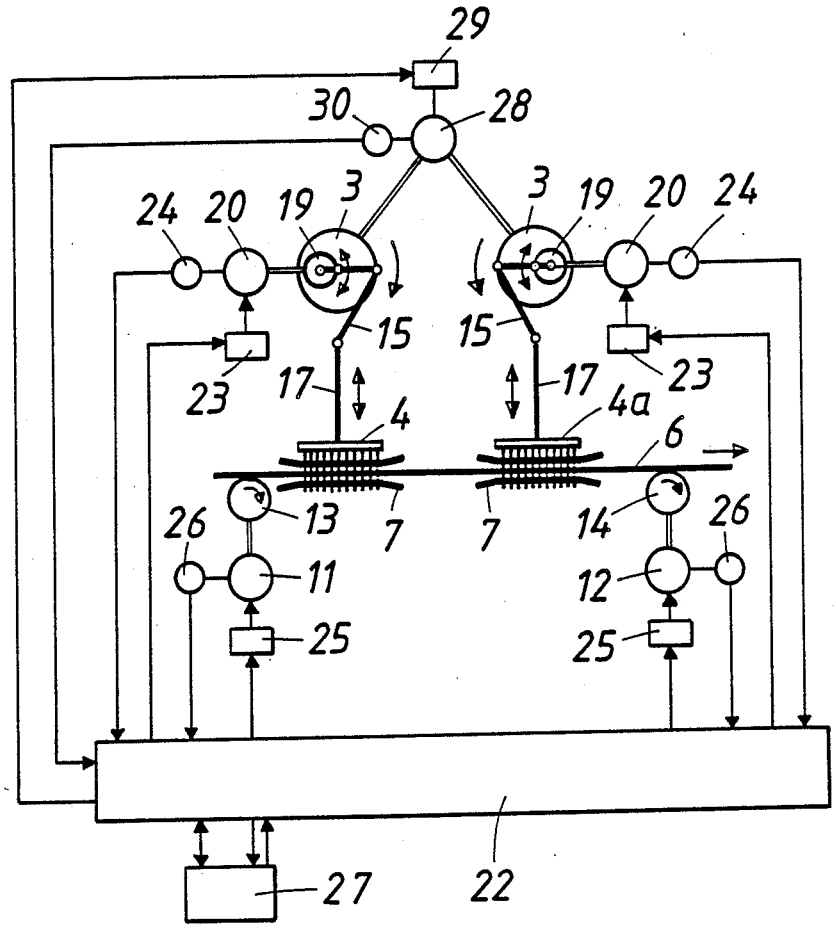
FIG. 3 is a block circuit diagram which is similar to FIG. 2 and related to a different design.

In order to increase the variety of patterns which can be made, two needle boards 4 and 4*a* as shown in FIG. 3 may be used rather than a single needle board. Said two needle boards are arranged one behind the other in the direction of movement of the felt web. The stroke positions of the needle boards 4 and 4*a* may be controlled independently of each other so that the series of patterns which are produced by the needle board 4*a* can be superimposed on the series of patterns formed by the needle board 4 which is nearer to the inlet end. The stroke positions of the two needle boards 4 and 4*a* are similarly controlled because each setting motor 20 is controlled by the controller 22 so as to effect the desired adjustment of the associated setting mechanism 19. In the embodiment shown in FIG. 3, the setting mechanism 19 consists of a setting eccentric, in which the drive shaft of the needle board drive 3 is rotatably mounted. Because the elevation of the drive shaft that is mounted in the drive eccentric will determine the stroke position of the associated needle board, the setting eccentric of the setting mechanism 19 may be used for the setting of a suitable stroke position. In that case, there is no need for a rocker 16 between the connecting rod 15 and the push rod 17 and the latter is directly connected to the connecting rod 17.

In accordance with FIG. 3, a common main drive motor 28 is provided for the needle board drives 3 for the two needle boards 4 and 4*a*, but separate drives for the two needle boards might be provided so that a larger variety of patterns can be made by the use of different stroke frequencies resulting in different depths of penetration.

I claim:

1. A needling apparatus for making a patterned felt web, comprising the combination of (a) a felt web support, (b) a stripper defining a multiplicity of spaced apart passages, (1) the stripper being disposed over the felt web support and constituting a felt web guide therewith, (c) feed drive means for continuously feeding a felt web on the felt web support through the felt web guide at a controllable feeding speed, (d) needle board means disposed on a side of the stripper which is opposite to the felt web support, the needle board means comprising (1) a multiplicity of needles projecting toward the felt web guide and registering with respective ones of the passages, (e) drive means for the needle board means for reciprocating the needle board means to move the needles through the passages into and out of the felt web guide, (f) stroke setting means for setting a stroke position of the needle board means relative to the felt web guide between an idle stroke position wherein there is no penetration of the needles into the felt web and a working stroke position wherein there is a maximum depth of penetration of the needles into the felt web continuously fed along the felt web support, (1) the patterns of the felt web being determined by variations in the depth of penetration of the needles into the felt web, and (g) control means for controlling the feeding speed imparted by the feed drive means to the felt web in dependence on the stroke position of the needle board means relative to the felt web guide in accordance with a programmed coordination of the stroke position of the needle board means and the feeding speed of the felt web.

* * * * *